US007581716B2

(12) United States Patent
Tsai

(10) Patent No.: US 7,581,716 B2
(45) Date of Patent: Sep. 1, 2009

(54) AERATION EQUIPMENT

(76) Inventor: Rong-Feng Tsai, No. 24, Ho Ping Rd., Huwei Chen, Yunlin Hsien (TW)

( * ) Notice: Subject to any disclaimer, the term of this patent is extended or adjusted under 35 U.S.C. 154(b) by 530 days.

(21) Appl. No.: 11/441,145

(22) Filed: May 26, 2006

(65) Prior Publication Data

US 2006/0279006 A1 Dec. 14, 2006

(30) Foreign Application Priority Data

Jun. 9, 2005 (TW) ..... 94119123 A

(51) Int. Cl.
*B01F 3/04* (2006.01)

(52) U.S. Cl. ..... 261/5; 261/26; 261/36.1; 261/40; 261/120; 239/265.25

(58) Field of Classification Search ..... 261/4, 261/5, 26, 34.1, 36.1, 40, 115, 120; 239/23, 239/725, 738, 747, 265.25
See application file for complete search history.

(56) References Cited

U.S. PATENT DOCUMENTS 3,337,133 A * 8/1967 Duerkob ..... 239/18
3,496,901 A 2/1970 Stanfield et al.
3,838,816 A * 10/1974 Huff et al. ..... 239/18
4,482,510 A * 11/1984 Khudenko ..... 261/91
4,587,064 A * 5/1986 Blum ..... 261/37
4,680,148 A * 7/1987 Arbisi et al. ..... 261/120
5,185,085 A * 2/1993 Borgren ..... 210/747
5,357,895 A * 10/1994 Ceko ..... 114/343
5,510,022 A * 4/1996 Mullis ..... 210/170.06
5,918,809 A * 7/1999 Simmons ..... 239/17
D502,983 S * 3/2005 Mitjans ..... D23/201
7,396,456 B2 * 7/2008 Tsai ..... 210/167.1
7,427,221 B2 * 9/2008 Blumenthal et al. ..... 440/39

FOREIGN PATENT DOCUMENTS

GB 2 366 218 A 3/2002
JP 07-08987 A 1/1995
WO WO-98/22337 A1 5/1998

* cited by examiner

*Primary Examiner*—Scott Bushey
(74) *Attorney, Agent, or Firm*—Muncy, Geissler, Olds & Lowe, PLLC.

(57) ABSTRACT

The methods and the apparatuses of an aeration equipment are described. A floatable aeration equipment with mobility at least has a floatable apparatus, a plurality of aeration apparatuses, and a controller. The thrust causing the motion of the aeration equipment is generated from the aeration apparatuses while aerating. The moving directions and positions of aeration equipment are controlled by a controller, which switches on/off a power source of one or more selected aeration apparatus.

18 Claims, 8 Drawing Sheets

AERATION EQUIPMENT

RELATED APPLICATIONS

The present application is based on, and claims priority from, Taiwan Application Ser. Number 94119123, filed Jun. 9, 2005, the disclosure of which is hereby incorporated by reference herein in its entirety.

TECHNICAL FIELD

The present invention generally relates to the aeration equipment, and more particularly, the methods of the movement and controls of an aeration equipment, which moves by employing the reacting forces generated while aerating, and controlling the direction of movement with a control device to determine the resultant direction.

BACKGROUND

The major method of maintaining the concentration of the D.O. (Dissolved Oxygen) in the aquafarms and fisheries is often employed by the aeration equipment, which maintains adequate respiration conditions for aquatic products, water life, and microorganisms. The stability of the water quality and the ecological balance are maintained as well.

The microorganisms (decomposers) have to absorb the dissolved oxygen for digesting the waste organisms in accordance with the process of the nitrification, converting the high toxicant ammonia gas into the weak toxicant nitrite nitrogen ($NO_2$) or nitrate nitrogen ($NO_3$).

A waterwheel, one embodiment of prior art aeration equipment, spins and stirs up the nearby water with its motor vanes for the extension of the contacting area and the contacting time between the water and the air, resulting in an increase of the concentration of the D.O. and aeration.

It is already known that the aerated aerobic pools of sewage treatment plants of the ecological industry and the chemical industry often employ microorganisms to digest the organisms in sewage water.

These related industry proprietors mostly use a blast furnace and a pipe to introduce air into the air-dissipation plate placed at the bottom of the pool, and then air is sprayed out from the air-dissipation plate in bubbles. Thus, the concentration of the D.O. is increased.

Nowadays, the functions of increasing the D.O. and the aeration in the aquafarms or the fisheries are still performed by conventional aeration equipment, waterwheels, which are fixed. Therefore, the aerating range is narrowed and limited to surrounding waters the same in the aquafarms or fisheries.

Due to the limitations of the waterwheels, it is necessary to position several waterwheels in an aquafarm or fishery with vast aquatic water area to maintain or increase the concentration of the D.O. of the aquatic water. Consequently, the more waterwheels are planted, the more cost will be increased; thus, power will be greatly consumed.

SUMMARY OF THE INVENTION

An object of the present invention is to provide an aeration equipment having a plurality of pumps of an aeration apparatus that has higher aeration efficiency and effectiveness than the conventional aeration equipment, such as a waterwheel.

An additional object of the present invention is the provision of an aeration equipment having a plurality of aeration apparatuses, arranged in an asymmetric disposition, with a plurality of nozzle assemblies that generate a thrust to move the aeration equipment.

Another object of the present invention is to provide an aeration equipment having the aforesaid thrust that provides the aeration equipment with the mobility and a larger aerating range than the fixed aeration equipment, such as a waterwheel.

A further object of the present invention is the provision of an aeration equipment having a plurality of aeration apparatuses where the direction of movement of the aeration equipment can be determined by employing a control device to switch on/off the plurality of aeration apparatuses having an asymmetric disposition by turns.

Yet another object of the present invention is to provide an aeration equipment having a plurality of jet aerators as an aerating resource that the jet aerators introducing the air from the water surface and draining the ambient water for mixing them both, and then, jetting this air-mixed water into the water as an aeration and generating the reacting forces as a thrust in the meantime.

A further additional object of the present invention is the provision of an aeration equipment further comprising a decoration apparatus that increases the function of the aeration equipment while aerating.

Yet a further object of the present invention is to provide an aeration that increases the concentration of the D.O. and the water quality.

An object of the present invention is the provision of an aeration equipment having the feature of mobility that reduces a number of the aeration equipments in one water area, successfully minimizing the cost thereof.

An additional objection of the present invention is to provide an aeration equipment that can be broadly employed in many kinds of water, such as a river, an aquatic production farm, a fishery, a pond, a pool, or a water resource area.

One embodiment of the present invention provides an aeration equipment comprising a plurality of aeration apparatuses, a floatable apparatus and a control device. The plurality of aeration apparatuses are mounted on the floatable apparatus. Each aeration apparatus has a plurality of pumps for pumping the water and at least a nozzle assembly, comprising at least one nozzle, for aerating and jetting out the water. The reacting forces are generated from the nozzle assemblies of the plurality of aeration apparatuses while jetting out and aerating the water. Owing to the resultant of the reacting forces, the thrust, generated by the nozzle assemblies, the aeration equipment is able to move in a direction opposite the nozzle assembly.

For the aforementioned aeration equipment, a control device is used to control and switch the plurality of aeration apparatuses arranged in a desirable order on the floatable apparatus. In switching on/off the action of the selected aeration apparatus for the determination of the direction of the resultant, the resultant, a thrust, results from the reacting force of each nozzle assembly of each aeration apparatus. Therefore, the direction of movement of the aeration equipment is determined by switching one or more selected aeration apparatuses with the control device. This mobility of the aeration equipment allows an enlarged, more effective aerating area.

In another embodiment of the present invention, the aeration equipment has a plurality of aeration apparatuses, which are the plurality of jet aerators, often used for sewage treatment in environmental engineering or chemical engineering. These jet aerators pump water and air from ambient water surface, mix them together, and then spray them out into the water. Thus, the aeration is performed and the reacting forces are generated at the same time. The control device is used to make the aeration equipment moving in the selected direction by employing the resultant of the reacting forces generated from the aeration apparatuses so that the aerating range can be greatly enlarged.

The aforementioned aeration apparatus will be referred to hereinafter as a jet aerator or an aeration apparatus with at least one nozzle assembly.

In a preferable embodiment of the present invention, an aeration equipment comprises a floatable apparatus, a control device, and two aeration apparatuses, mounted on the floatable apparatus. Therefore, two different magnitudes of the reacting forces are generated from two aeration apparatuses, respectively, in which the first aeration apparatus generates a greater reacting force than the second aeration apparatus. Consequently, the direction of the aeration equipment is the same as the resultant of the reacting forces, generated from the first and the second aeration apparatuses.

The aforementioned the aeration apparatus will be referred to hereinafter as a jet aerator or an aeration apparatus with at least one nozzle assembly.

In another embodiment of the present invention, the direction of movement of the aforesaid aeration equipment is determined by the direction of the resultant of the reacting forces and the aeration equipment moving in the opposite direction of the resultant of the reacting forces. It is readily known that the direction of movement of the aforesaid aeration equipment is controlled by switching on/off the first aeration apparatus while the second aeration apparatus is always switched on. Hence, the aforesaid aeration equipment moves against the direction of the resultant of the reacting forces where the first and the second aeration apparatuses generate the resultant of the reacting forces.

For the aforementioned embodiment, the aeration equipment is able to move back and forth when the first aeration apparatus is juxtaposed and aligned with the second aeration apparatus. The included angle of the reacting forces of two aeration apparatuses reaches 180 degrees.

In one embodiment of the present invention, an aeration equipment comprises a floatable apparatus, a control device, and a plurality of aeration apparatuses arranged divisibly in a cyclic disposition and mounted on the floatable apparatus. Each aeration apparatus has at least a nozzle assembly, where the outlet of the nozzle assembly is arranged to face the exterior of the cyclic disposition. The mobility of the aeration equipment results from the control of switching each aeration apparatus by turns.

The aforementioned aeration apparatus will be referred to hereinafter as an jet aerator, a spraying apparatus, or an aeration apparatus with the nozzle assembly.

In another embodiment of the present invention, an aeration equipment comprising a floatable apparatus, a control device, and a plurality of aeration apparatuses arranged in an alignment and mounted on the floatable apparatus. The nozzle assemblies of two aeration apparatuses, installed in both ends of the alignment of the plurality of aeration apparatuses, face opposite directions. Thus, the final resultant of the reacting forces can be only determined by these two aeration apparatuses, installed in the ends of the alignment and when the spraying apparatuses, spraying the air-mixed water and generating neglected minor reacting forces, are arranged amid those two aeration apparatuses.

In one embodiment of the present invention, an aeration equipment further comprising a floatable apparatus, a control device, a plurality of aeration apparatuses and a decoration apparatus mounted on the floatable apparatus. The decoration apparatus has nothing to do with the aerating and has no influence on the function of the plurality of aeration apparatuses.

The aforementioned decoration apparatus will be referred to hereinafter as a deco art, an advertisement, or a display view model.

BRIEF DESCRIPTION OF THE DRAWINGS

The objects and other advantages of this invention are best described in the preferred embodiment with reference to the attached drawings that include.

DETAILED DESCRIPTION

Figure 1:
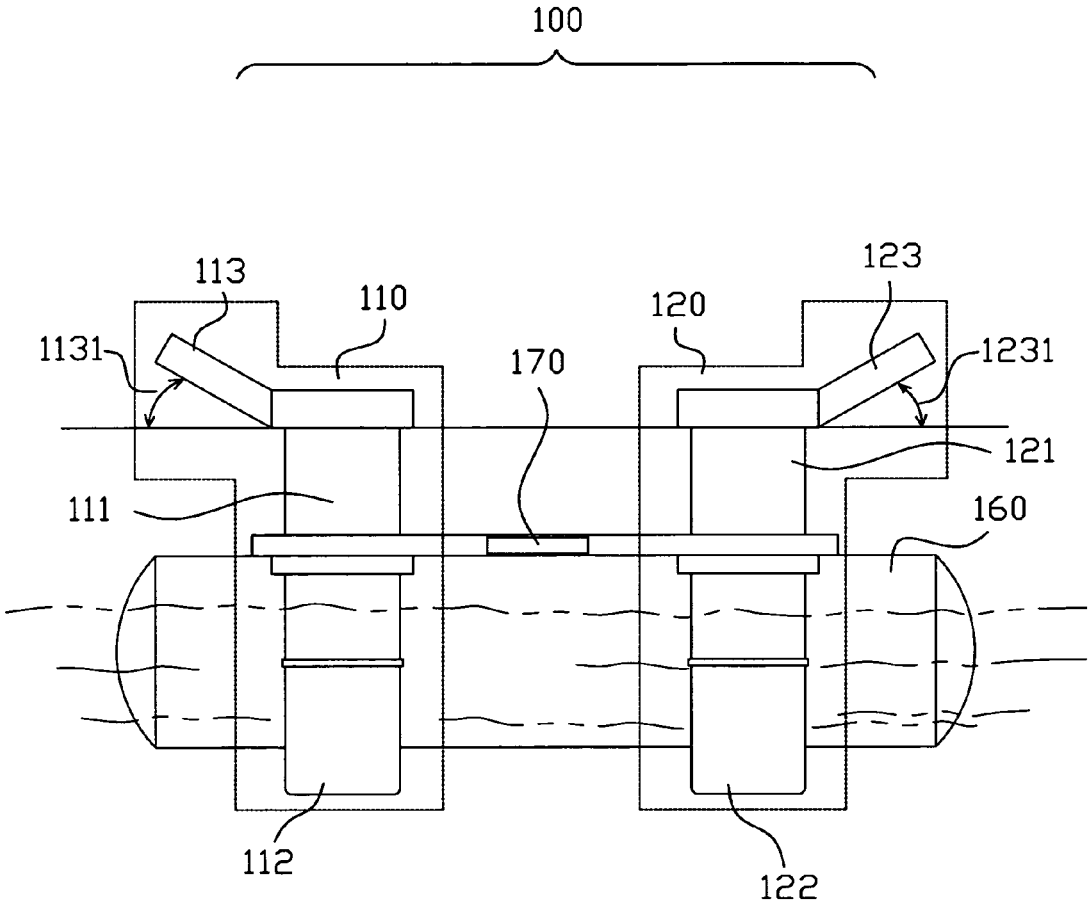
FIG. 1 illustrates the side view of an aeration equipment of a preferred embodiment of the present invention.
Figure 2:
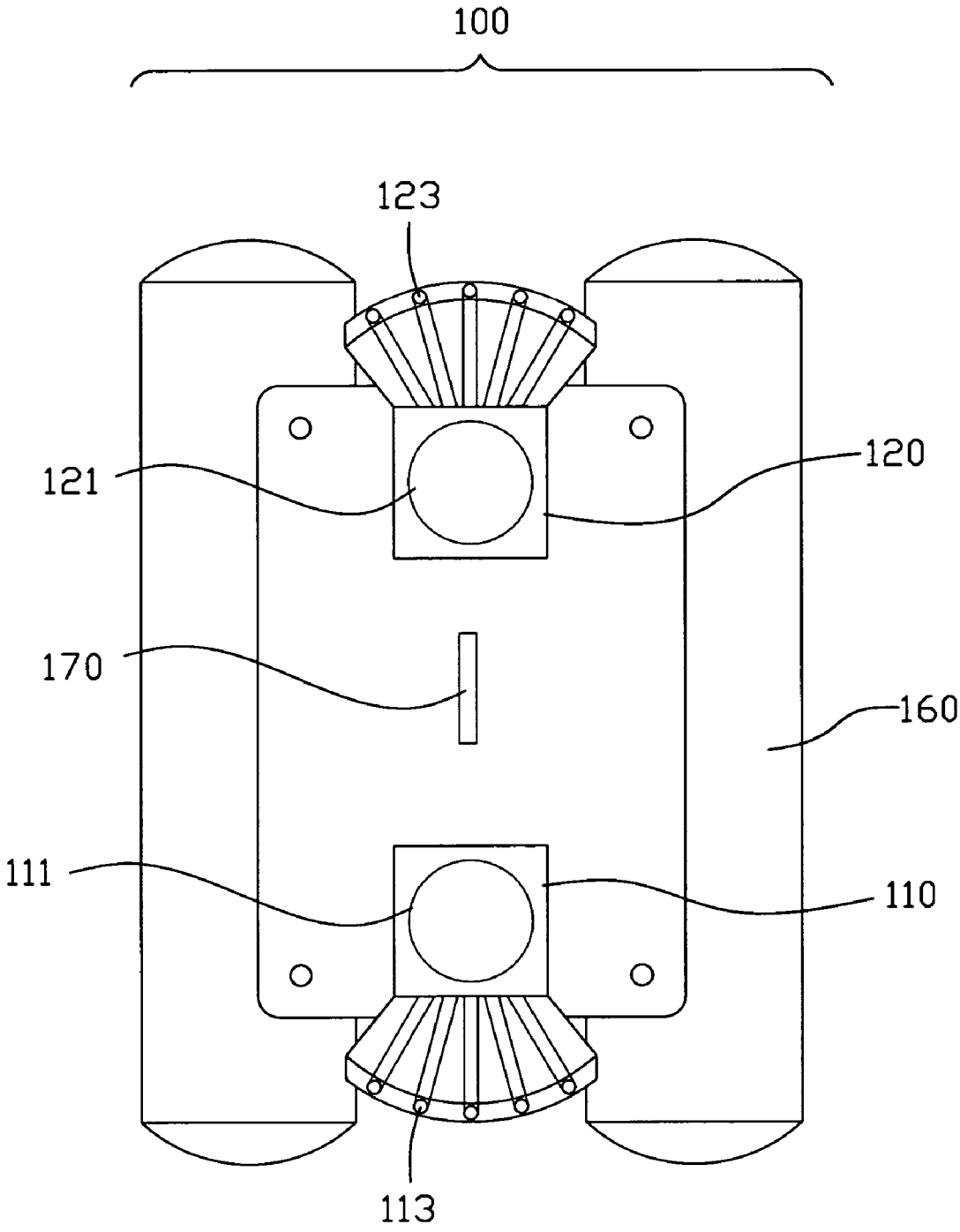
FIG. 2 shows the top view of an aeration equipment of another preferred embodiment of the present invention.

FIG. 1 and FIG. 2 illustrate the side view and the top view respectively of an aeration equipment 100 of the preferred embodiment of the present invention, where the aeration equipment 100 has a plurality of aeration apparatuses. The aforementioned plurality of aeration apparatuses will be referred to hereinafter as two aeration apparatuses.

The aeration equipment 100 of a preferred embodiment of the present invention comprises a first aeration apparatus 110, a second aeration apparatus 120, a floatable apparatus 160, and a control device 170. The first aeration apparatus 110 and the second aeration apparatus 120 are both mounted on the floatable apparatus 160. The floatable apparatus 160 is able to float on the water. The control device 170 is used to shift the operating statuses of the first aeration apparatus 110 and the second aeration apparatus 120 by switching on/off.

The first aeration apparatus 110 has a first pump 111 with one water inlet and one water outlet to pump the water. The first pump 111 has a first filter 112 installed in the water inlet and a first nozzle assembly 113 installed in the water outlet. Each of the first nozzle assembly 113 has a first elevation angle 1131 ranging from 15 degrees to 50 degrees. The first nozzle assembly 113 can be replaced by a plurality of the first nozzle assemblies 113 arranged in a radial manner or the like.

The second aeration apparatus 120 has a second pump 121 with another water inlet and another water outlet to pump the water. The second pump 121 has a second filter 122 installed in the water inlet and a second nozzle assembly 123 installed in the water outlet. Each of the second nozzle assembly 123 has a second elevation angle 1231 ranging from 15 degrees to 50 degrees. The second nozzle assembly 123 can be replaced by a plurality of the first nozzle assemblies 123 arranged in a radial manner or the like.

The aforesaid aeration equipment 100 employs the first pump 111 of the first aeration apparatus 110 and the second pump 121 of the second aeration apparatus 120 to introduce the water and then spray water out from first nozzle assembly 113 of the first pump 111 and the second nozzle assembly 123 of the second pump 121. Since the orientation of the nozzle assembly 113 is opposite that of the nozzle assembly 123, the first aeration apparatus 110 and the second aeration apparatus 120 do not start at the same time. In one embodiment of the aforesaid aeration equipment 100 of the present invention, when the first aeration apparatus 110 is on and the second aeration apparatus 120 is off, the first pump 111 pumps in the water and then sprays the water out from the nozzle assembly 113 for aeration. Meanwhile, thrust is generated by the reacting forces by the water spraying out. The thrust enables the aeration equipment 100 to move in the first direction. In another embodiment of the aforesaid aeration equipment 100 of the present invention, switching on the second aeration apparatus 120 and switching off the first aeration apparatus 110 makes the second pump 121 pump the water and then spray the water out from the nozzle assembly 123 for aeration. The thrust is generated by the reacting forces while the water sprays out. The thrust enables the aeration equipment 100 to move in the second direction. Therefore, the aeration equipment 100 effectively increases the performance and the range of aeration from this mobility. The power magnitude of the first pump and the second pump both are not limited; they can be the same or not.

The arrangement of the nozzle assembly 113 of the first aeration apparatus 110 and the nozzle assembly 123 of the second aeration apparatus 120 may be symmetric or asymmetric. The first aeration apparatus 110 is arranged on the opposite side of the second aeration apparatus 120 on the floatable apparatus 160, so the nozzle assembly 113 of the first aeration apparatus 110 naturally faces the opposite direction of the nozzle assembly 123 of the second aeration apparatus 120. At this time, the control of the first pump 111 and the second pump 121 both are employed by the switch in order to control the water ejection periodically.

In another embodiment of the present invention, the first nozzle assembly 113 is switched on and the second nozzle assembly 123 is switched off at the same time. The thrust is generated from the reacting forces of the first nozzle assembly 113 and pushes the aeration equipment 100 to move automatically in a direction opposite of the first nozzle assembly 113. On the contrary, if the second nozzle assembly 123 is switched off and the first nozzle assembly 113 is switched off in the mean time, thrust is generated from the reacting forces of the second nozzle assembly 123 and pushes the aeration equipment 100 to move automatically in a direction opposite of the second nozzle assembly 123.

Additionally, the direction of movement of the aeration equipment 100 may be changed by employing the difference of the horizontal reacting forces which are generated by the first aeration apparatus 110 and the second aeration apparatus 120. One method to generate different horizontal reacting forces is to adopt different powers of the pumps arranged on the first aeration apparatus 110 and the second aeration apparatus 120 individually. Another method to generate different horizontal reacting forces is to design a new nozzle assembly arranged on the first aeration apparatus 110 and the second aeration apparatus 120 individually. Examples are a nozzle assembly with different spout calibers, an asymmetric arrangement of the nozzle assemblies, or furthermore, different numbers and elevation angles of the nozzle assemblies.

In a further embodiment of the present invention, the power of the first pump 111 is smaller than the power of the second pump 121 while using the same size nozzle assemblies on the aeration equipment 100. Therefore, the jetting water flow rate is in direct ratio with the magnitude of the power of the pump. Thus, the thrust, which is generated by the water ejection of the nozzle assemblies, is also in direct ratio with the power magnitude of the pump. The thrust of the first pump 111 is also smaller than the thrust of the second pump 121. The first pump 111 is switched into an "always on" mode, and the second pump 121 is switched intermittently in an "on/of" mode controlled by a control device (not shown in figures), and this enables the aeration equipment 100 to move in the first direction where the smaller thrust is generated. After the aeration equipment 100 moves in the first direction for a distance, the control device switches off the larger power pump, the second pump 121. So the aeration equipment 100 is able turn its direction of movement to the opposite direction of the first direction. The aeration equipment 100 thus has the ability to move back and forth.

In one embodiment of the present invention, in one aspect, the power of the first pump 111 is the same as the power of the second pump 121. The nozzle assembly having bigger angle of elevation produces smaller thrust than the nozzle assembly having smaller angle of elevation. Thus, the control device only controls the switch of the aeration apparatus with smaller angle of elevation of the nozzle assembly, which can produce bigger thrust, enabling the aeration equipment 100 to move freely. Therefore, the purpose of increasing the range of aeration and the performance are both accomplished.

Figure 3:
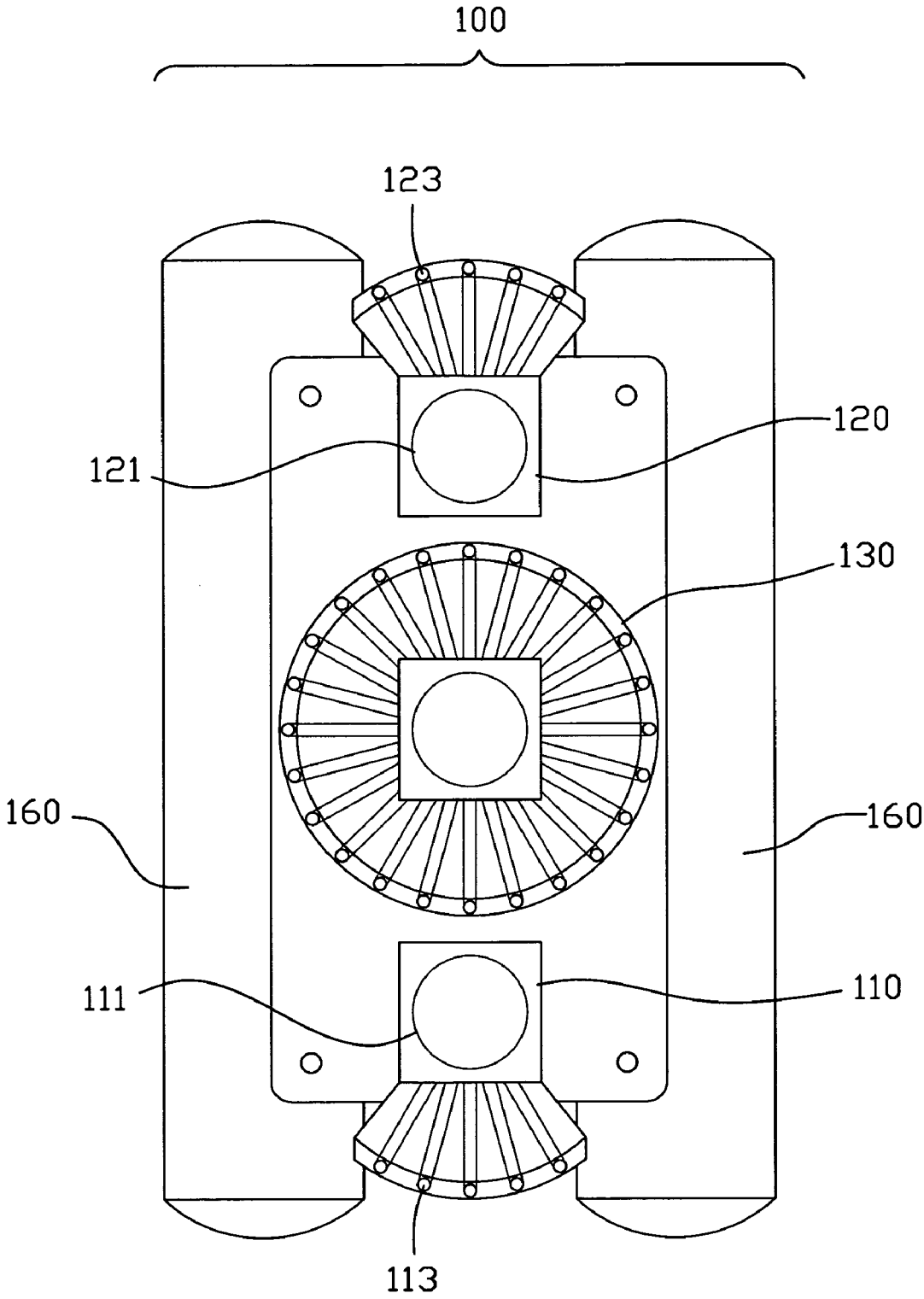
FIG. 3 depicts the top view of an aeration equipment of another preferred embodiment of the present invention where a plurality of aeration apparatuses of an aeration equipment are arranged in an alignment with each other.

FIG. 3 shows the aeration equipment 100 of the present invention equipped with three aeration apparatuses, which are a first aeration apparatus 110, a second aeration apparatus 120, and a third aeration apparatus 130, and they are arranged in alignment. The first aeration apparatus 110 and the second aeration apparatus 120 are respectively arranged on two sides of the floatable apparatus 160 correspondingly. The first nozzle assembly 113 and the second nozzle assembly 123 are individually arranged to face the opposite direction with one another correspondingly. The third aeration apparatus 130 can be additionally mounted on the floatable apparatus 160. At this moment, the resultant of the reacting forces is zero when the arrangement of the nozzle assembly of the third aeration apparatus 130 is arranged in cyclic disposition around a periphery thereof. The first aeration apparatus 110 and the second aeration apparatus 120 are controlled in the manner described before whether the arrangement of the first nozzle assembly 113 and the second nozzle assembly 123 are placed correspondingly or not. The performance of the aeration equipment 100 can be increased with the third aeration apparatus 130. Moreover, these three aeration apparatuses can be also arranged in a cyclic disposition, and the nozzle assemblies of these three aeration apparatuses face radically outward.

Figure 4:
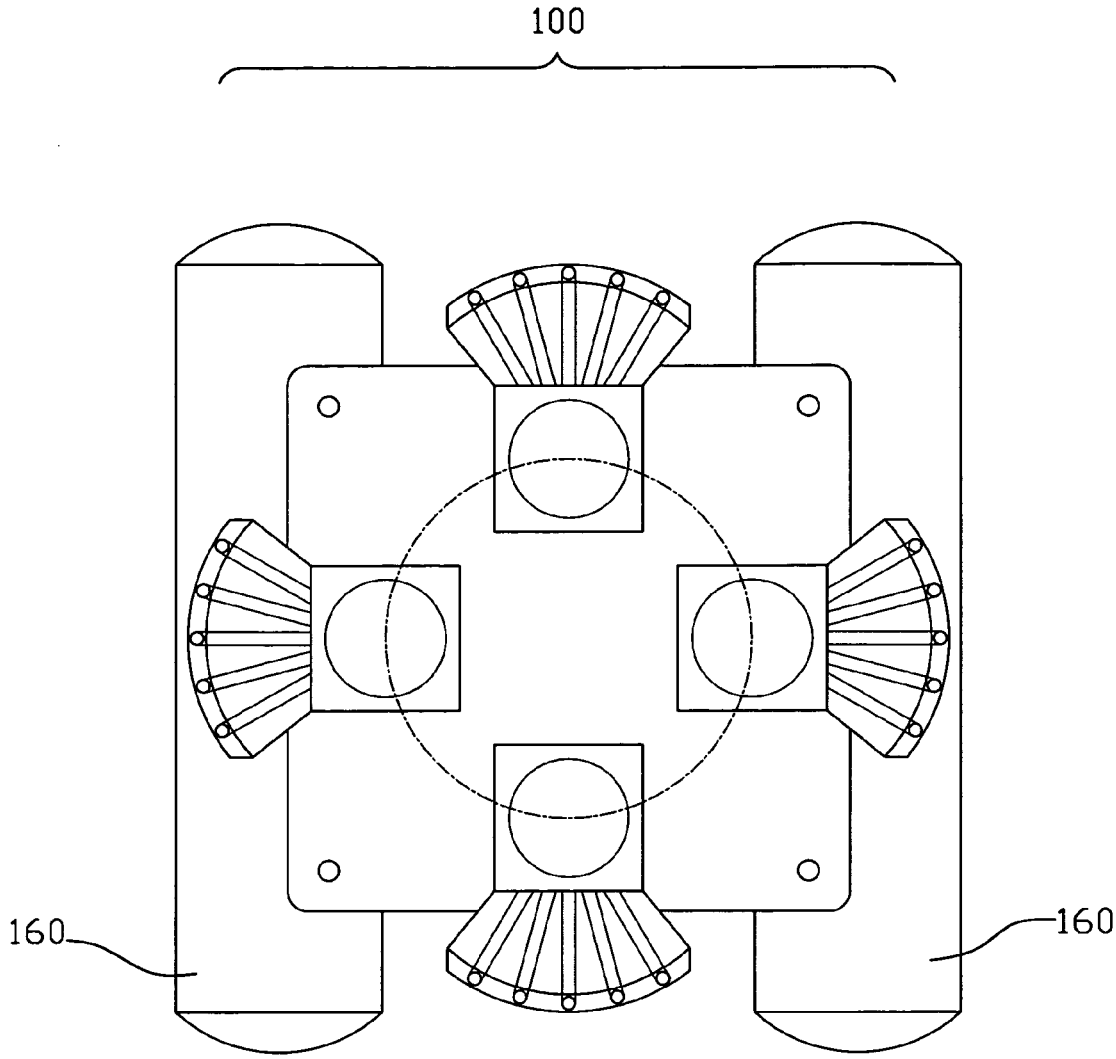
FIG. 4 depicts the top view of an aeration equipment of another preferred embodiment of the present invention where a plurality of aeration apparatuses of an aeration equipment are arranged in a cyclic disposition divisibly with each other.

FIG. 4 illustrates another embodiment of the aeration equipment 100 with four aeration apparatuses of the present invention. When these four aeration apparatuses are placed correspondingly and evenly with one another in a cyclic disposition and each aeration apparatus faces a different direction of the floatable apparatus 160, the aeration equipment 100 can move in the opposite direction of aeration apparatus, which is switched on while the others are switched off.

The aerating equipment 100 can move automatically by switching off any one apparatus of these four apparatuses and switching on the others; or turning off two apparatuses, which adjoin each other. The performance and the range of the aeration equipment 100 can be increased effectively with the mobility while the movement of the aeration equipment 100 can be controlled by switching these aeration apparatuses with orders.

Figure 5:
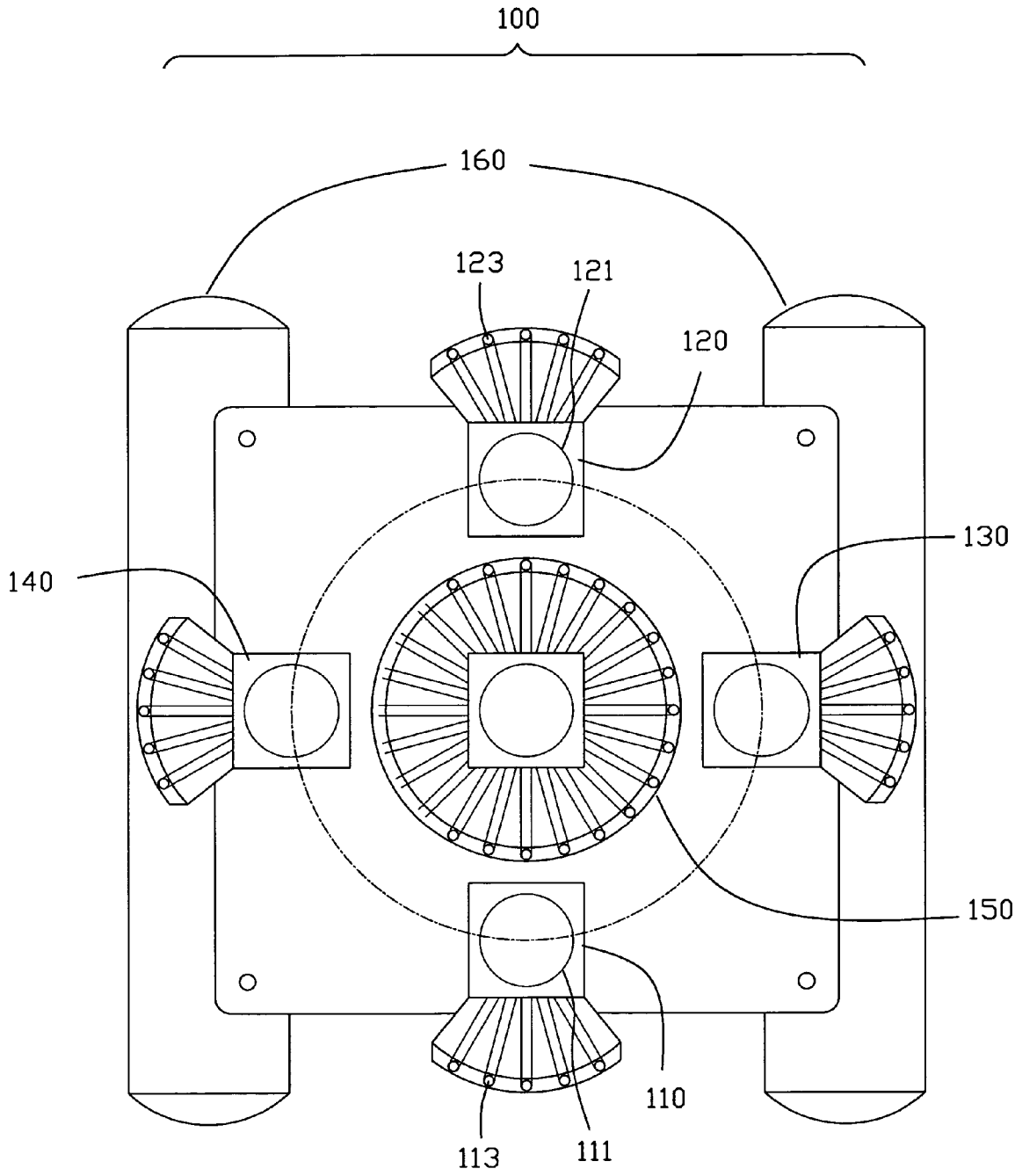
FIG. 5 depicts the top view of an aeration equipment of another preferred embodiment of the present invention where a plurality of aeration apparatuses of an aeration equipment are arranged in a cyclic disposition divisibly with each other, and further more, at least a aeration apparatus is installed in the central part the cyclic disposition.

FIG. 5 illustrates the embodiment of the multiple aeration apparatuses of the aeration equipment 100 of the present invention. The aeration equipment 100 further comprises a first aeration apparatus 110, a second aeration apparatus 120, a third aeration apparatus 130, a fourth aeration apparatus 140, a fifth aeration apparatus 150, a floatable apparatus 160, and a control device 170 (not shown in FIG. 5). These peripheral aeration apparatuses are arranged correspondingly and evenly with each other in a cyclic disposition, and moreover, an aeration apparatus 150 is also installed in the center of the floatable apparatus 160. A nozzle assembly of the central aeration apparatus 150, arranged in the center of the floatable apparatus 160, has a circular shaped nozzle assembly such that the resultant of the reacting forces generated by the nozzle assembly is zero.

Figure 6:
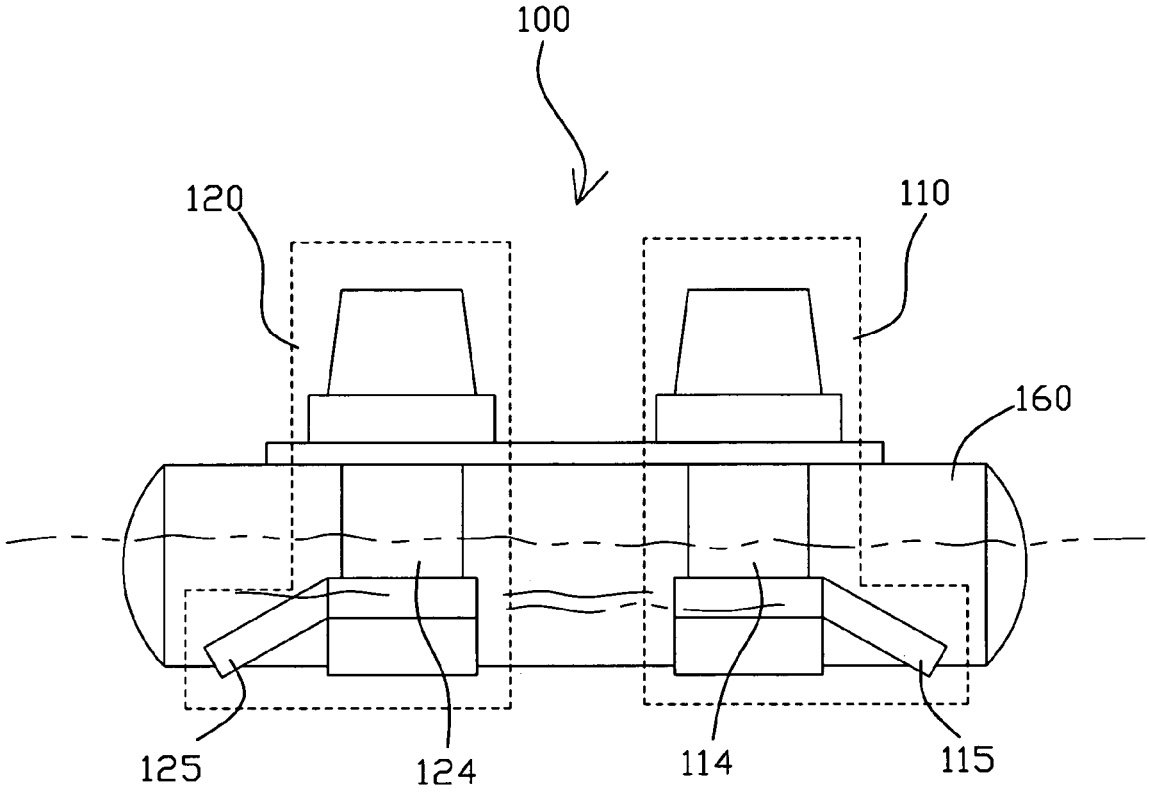
FIG. 6 illustrates the side view of an aeration equipment of another preferred embodiment of the present invention.

FIG. 6 illustrates the side view of the preferred embodiment of the present invention, including an aeration equipment 100. The aeration equipment 100 of the embodiment comprises a first aeration apparatus 110 having a first jet aerator 114 as a power source. The first jet aerator 114 generally comprises an air inlet duct, a jet foundation, a gas mixing chamber, and a diffusion pipe. The aerating bubbles are generated beneath the water surface from a third nozzle assembly 116 connecting with the gas mixing chamber, where the air and the water are both introduced, and the third nozzle assembly 116 are arranged in a radial manner.

The second aeration apparatus 120 has a second jet aerator 124 as the power source. The second jet aerator 124 also comprises an air inlet duct, a jet foundation, a gas mixing chamber, and a diffusion pipe. The aerating bubbles are generated beneath the water surface from the fourth nozzle assembly 126 connecting with the gas mixing chamber where the air and the water are both introduced, and the fourth nozzle assembly 126 are arranged in a radial manner. The first jet aerator 114 and the second jet aerator 124 can have the same power or not.

In the foregoing aeration equipment 100, the first pump 111 and the second pump 121 both can also be replaced by the first jet aerator 114 and the second jet aerator 124. Even so, the composition of the whole structure and the method to control the movement of the aeration equipment are still the same. It also includes the arrangement of plurality apparatuses in, for example, a line or a circle. The purpose of the performance and the increase of the aeration range can both be accomplished effectively by utilizing the free mobility of the aeration equipment 100.

The foregoing disclosures show that the magnitude of the thrust of the reacting forces of the aeration equipment 100 is determined by the flow rate and the disposition of the nozzle assemblies. On one hand, the symmetric disposition of the nozzle assemblies generates a zero thrust, the resultant of the reacting forces. On the other hand, the asymmetric disposition of the nozzle assemblies may generate a nonzero thrust, the resultant of the reacting forces, in which the thrust can be increased with the flow rate in direct ratio at the same time.

Figure 7:
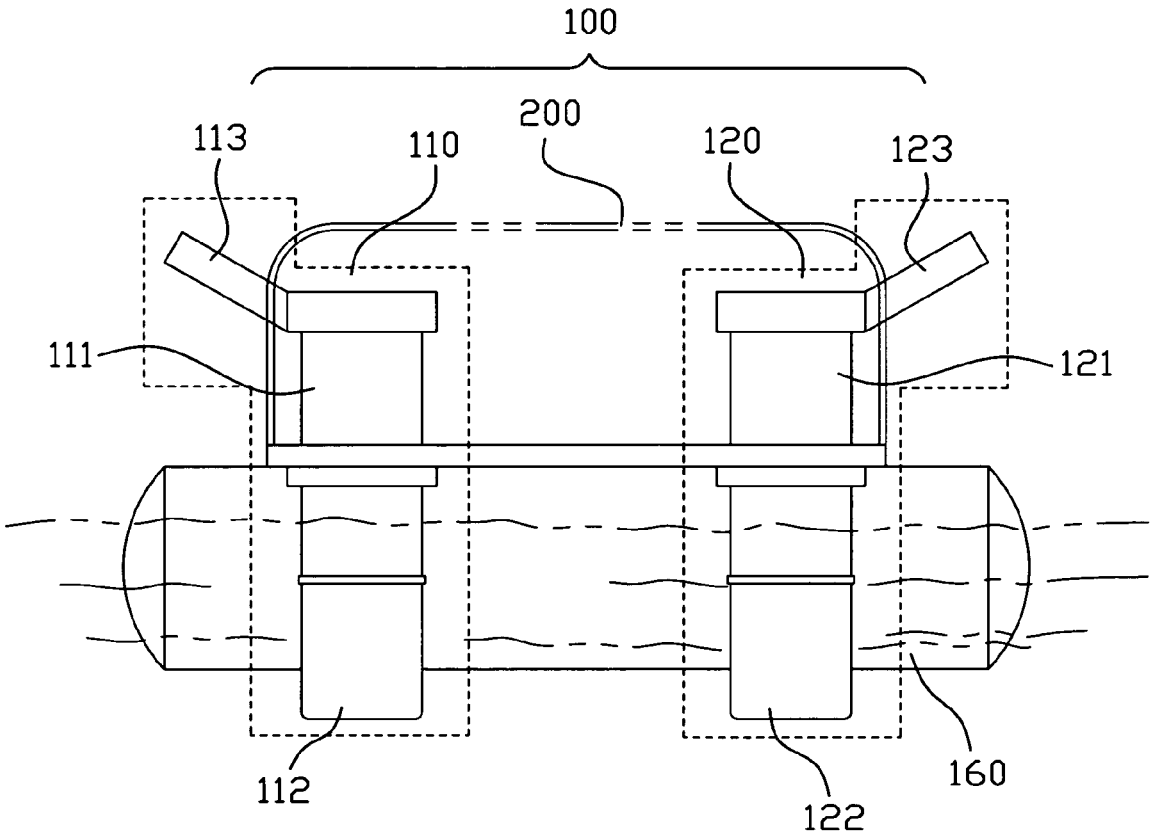
FIG. 7 illustrates the side view of an aeration equipment of another preferred embodiment of the present invention and the aeration equipment having a plurality of jet aerators as a plurality of aeration apparatuses.
Figure 8:
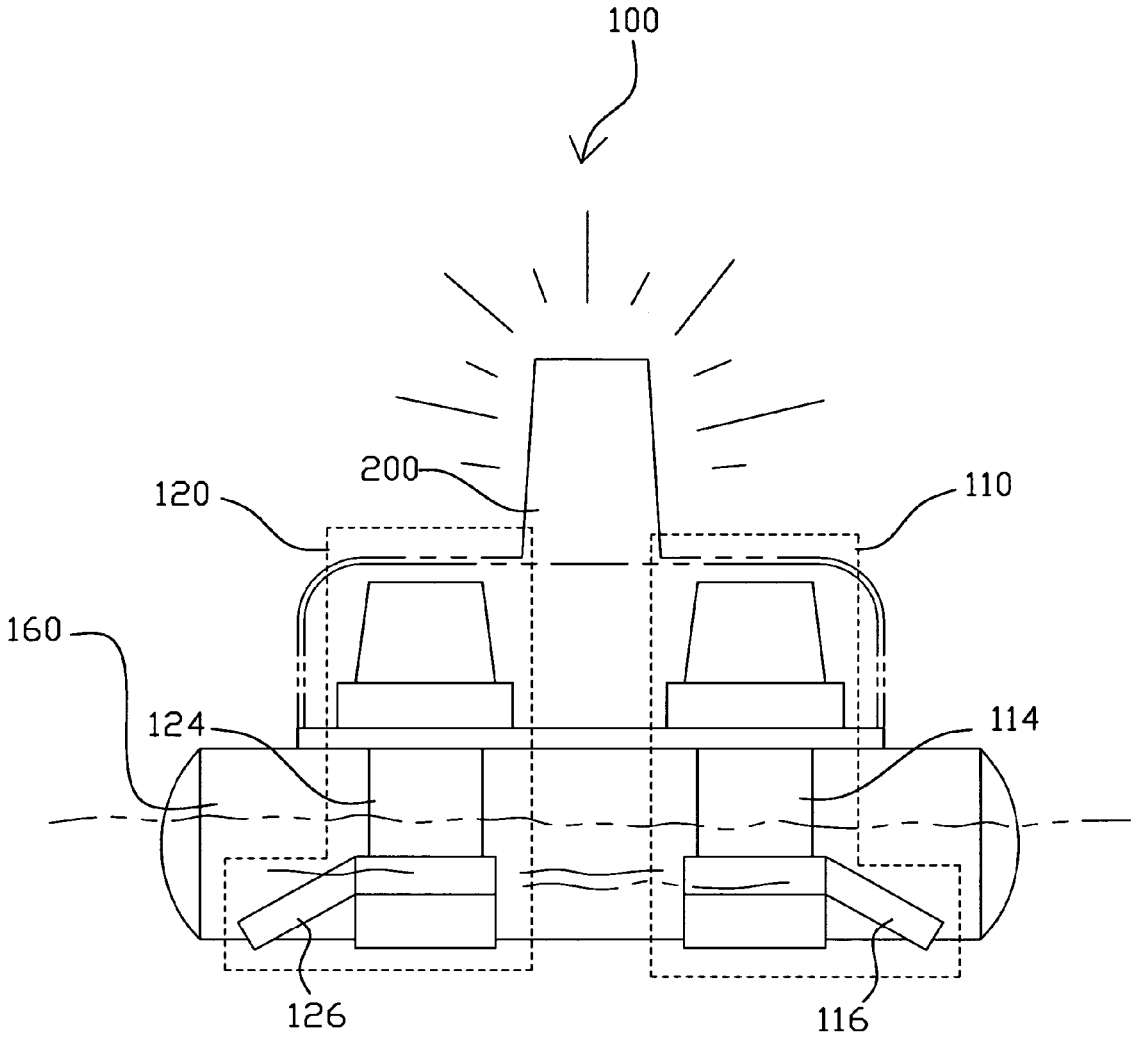
FIG. 8 illustrates a side view of an aeration equipment of another preferred embodiment of the present invention and the aeration equipment further comprising a decoration apparatus mounted on a floatable apparatus of the aeration equipment.

FIG. 7 and FIG. 8 both illustrate a decoration apparatus 200 mounted on the external of the first aeration apparatus 110 and the second aeration apparatus 120 of the aeration equipment 100 of the present invention. The decoration apparatus 200 is, for example, a deco art, an advertisement, a display view model, a warning apparatus, or a lighting apparatus (such as a signal apparatus). The aforementioned apparatuses of the decoration apparatus 200 provide the aeration equipment 100 aerating, stabilizing the water quality, and advertising/entertaining in a pool in a park, or a fair, or other entertainment venue.

What is claimed is:

1. An aeration equipment comprising:

a floatable apparatus floating on a water surface; and at least one pair of aeration apparatuses mounted on the floatable apparatus, each pair of aeration apparatuses comprising:

a first aeration apparatus and a second aeration apparatus disposed on the floatable apparatus and along a moving route thereof;

a nozzle assembly disposed on each aeration apparatus;

a pump disposed on each aeration apparatus and introducing water and generating water jets through the nozzle assembly, wherein the nozzle assembly of the first aeration apparatus and the nozzle assembly of the second aeration apparatus are operable to jet water generally in two opposite directions to each other;

a filter filtering the intake water at an inlet of the pump; and a control device being operable to alternate between a first operation manner and a second manner to drive the floatable apparatus in the two opposite directions along the moving route thereof, wherein the first operation manner is to simultaneously switch on the first aeration apparatus and switch off the second aeration apparatus, and the second manner is to simultaneously switch off the first aeration apparatus and switch on the second aeration apparatus.

2. The aeration equipment of claim 1, wherein the first aeration apparatus and the second aeration apparatus are disposed at two opposite edges of the floatable apparatus.

3. The aeration equipment of claim 1, wherein the nozzle assembly and pump of the first aeration apparatus are operable to provide a first flow rate while the nozzle assembly and pump of the second aeration apparatus are operable to provide a second flow rate, wherein the first flow rate is equal to the second flow rate.

4. The aeration equipment of claim 1, wherein the nozzle assembly and pump of the first aeration apparatus are operable to provide a first flow rate while the nozzle assembly and pump of the second aeration apparatus are operable to provide a second flow rate, wherein the first flow rate is different from the second flow rate.

5. The aeration equipment of claim 1, wherein the nozzle assembly of the first aeration apparatus is disposed above the water surface.

6. The aeration equipment of claim 5, wherein the nozzle assembly of the second aeration apparatus is disposed above the water surface.

7. The aeration equipment of claim 1, further comprising a third aeration apparatus disposed between the first aeration apparatus and the second aeration apparatus.

8. The aeration equipment of claim 6, wherein the nozzle assembly of the third aeration apparatus has a plurality of nozzles disposed cyclically around the pump of the third aeration apparatus.

9. The aeration equipment of claim 8, wherein all the nozzles axe arranged with water-jetting directions radially outward relative to the pump of the third aeration apparatus.

10. The aeration equipment of claim 1, wherein the nozzle assembly of the first aeration apparatus is immersed under the water surface.

11. The aeration equipment of claim 10, wherein the nozzle assembly of the second aeration apparatus is immersed under the water surface.

12. The aeration equipment of claim 1, wherein the nozzle assembly of the first aeration apparatus has an elevation angle ranging from 15 degrees to 50 degrees.

13. The aeration equipment of claim 12, wherein the nozzle assembly of the second aeration apparatus has an elevation angle ranging from 15 degrees to 50 degrees.

14. The aeration equipment of claim 1, further comprising a decoration apparatus mounted on the floatable apparatus.

15. The aeration equipment of claim 14, wherein the decoration apparatus is a deco art.

16. The aeration equipment of claim 14, wherein the decoration apparatus comprises an advertisement, a designed outlook or a lighting apparatus.

17. The aeration equipment of claim 1, wherein the first aeration apparatus is a jet aerator.

18. The aeration equipment of claim 17, wherein the second aeration apparatus is a jet aerator.

* * * * *